US008040245B2

(12) United States Patent
Koblasz

(10) Patent No.: US 8,040,245 B2
(45) Date of Patent: Oct. 18, 2011

(54) HAND WASHING MONITOR FOR DETECTING THE ENTRY AND IDENTIFICATION OF A PERSON

(75) Inventor: Arthur Koblasz, Atlanta, GA (US)

(73) Assignee: GT Angel, LLC, Atlanta, GA (US)

( * ) Notice: Subject to any disclaimer, the term of this patent is extended or adjusted under 35 U.S.C. 154(b) by 435 days.

(21) Appl. No.: 12/197,448

(22) Filed: Aug. 25, 2008

(65) Prior Publication Data

US 2009/0051545 A1 Feb. 26, 2009

Related U.S. Application Data

(60) Provisional application No. 61/127,803, filed on May 15, 2008, provisional application No. 60/965,979, filed on Aug. 23, 2007.

(51) Int. Cl.
*G08B 21/00* (2006.01)

(52) U.S. Cl. ..... 340/573.1; 222/23; 382/100

(58) Field of Classification Search ..... 340/573.1, 340/572.1; 222/23, 638; 382/100
See application file for complete search history.

(56) References Cited

U.S. PATENT DOCUMENTS

2002/0000449 A1* 1/2002 Armstrong ..... 222/52
2006/0132316 A1 6/2006 Wildman et al.
2006/0229822 A1 10/2006 Theobald et al.
2007/0008149 A1 1/2007 Bolling
2007/0015552 A1 1/2007 Bolling
2007/0106775 A1 5/2007 Wong
2007/0222554 A1* 9/2007 Hart ..... 340/5.6

FOREIGN PATENT DOCUMENTS

| | | |
|---|---|---|
| GB | 2417811 | 3/2006 |
| GB | 2425388 | 10/2006 |
| JP | 2002183296 | 6/2002 |
| JP | 2006209583 | 8/2006 |
| WO | WO 0221475 | 3/2002 |
| WO | WO 2006036687 | 4/2006 |
| WO | WO 2007129289 | 11/2007 |

* cited by examiner

*Primary Examiner* — Jeffery Hofsass
(74) *Attorney, Agent, or Firm* — Gardner Groff Greenwald & Villanueva, PC

(57) ABSTRACT

Methods, systems, and computer-storage media provide for the monitoring of hand washing by people entering a room. A person is detected entering a room and an image of the person is captured. The person is identified as an employee using various employee identifiers or is identified as a visitor. The image may be used to identify distinguishing features of the visitor to be compared to an image subsequently during hand washing to verify the identity of the hand washer as the person who entered the room. Similarly, the employee identifier is used to verify the identity of a hand washer as the employee that entered the room. If any person entering the room remains for a threshold period of time without activating the soap dispenser, then a notification that includes the person's identity is provided within the room to remind the person that hand washing is required.

19 Claims, 10 Drawing Sheets

HAND WASHING MONITOR FOR DETECTING THE ENTRY AND IDENTIFICATION OF A PERSON

CROSS-REFERENCE TO RELATED APPLICATIONS

This patent application claims priority to U.S. provisional application having Ser. No. 60/965,979, entitled "Devices and Methods for Preventing Nosocomial Infections, Falls, and Medication Errors," filed Aug. 23, 2007, and to U.S. provisional application having Ser. No. 61/127,803, entitled "Patient Room Monitoring System that Detects Hand Washing Violations and also Detects Wandering, Falls, Medications Errors and Weight-Shifts," filed May 15, 2008, both of which are hereby incorporated herein by reference in their entireties.

BACKGROUND

Each year, multitudes of people acquire infections while admitted to hospitals. These infections, which are secondary to the conditions for which they were admitted, are known as nosocomial infections. Many nosocomial infections are caused by inadequate sanitation procedures or the failure of hospital staff and visitors to follow proper sanitation procedures. Thorough and regular hand washing is a sanitation procedure that when followed, can prevent a large number of nosocomial infections by mitigating the spread of dangerous germs.

To encourage frequent hand washing, most hospitals are equipped with hand washing stations in every patient room, as well as in public areas, restrooms, operating rooms, laboratories, and many other areas. Hospital personnel are told to wash their hands when entering any patient room prior to physically contacting the patient, except during emergency situations. Unfortunately, hospital staff and visiting doctors sometimes forget or ignore the recommended hand washing procedures, creating a potential for nosocomial infections. Visitors are even more likely than hospital personnel to ignore hand washing requests which further increases the likelihood of nosocomial infections. It is with respect to these considerations and others that the disclosure made herein is presented.

SUMMARY

It should be appreciated that this Summary is provided to introduce a selection of concepts in a simplified form that are further described below in the Detailed Description. This Summary is not intended to be used to limit the scope of the claimed subject matter.

Methods, systems, and computer storage media described herein provide for the monitoring of hand washing within a room. According to one aspect of the disclosure provided herein, a person entering a room is detected. A camera image of the person is captured and the identity of the person is determined using the camera image or an employee identification mechanism. The time each person remains in a room without activating a soap-dispenser is detected to determine whether the person washes his or her hands within an allotted period of time. If the person does not wash his or her hands within the allotted period of time, a notification of the failure is provided that includes the camera image or other identifiers.

According to another aspect described herein, a mechanism for detecting the entry of each person into the room is provided. Mechanisms are also provided for identifying each person entering the room and for identifying each person obtaining soap from a soap dispenser. Entry detection and identification data is used to determine whether the person entering the room activates the soap dispenser within an allotted amount of time after entering the room, and a notification that includes the identity of the person is provided in the room, warning the identified person to wash his or her hands.

The features, functions, and advantages that have been discussed can be achieved independently in various embodiments of the present invention or may be combined in yet other embodiments, further details of which can be seen with reference to the following description and drawings.

Detailed Description

Figure 1:
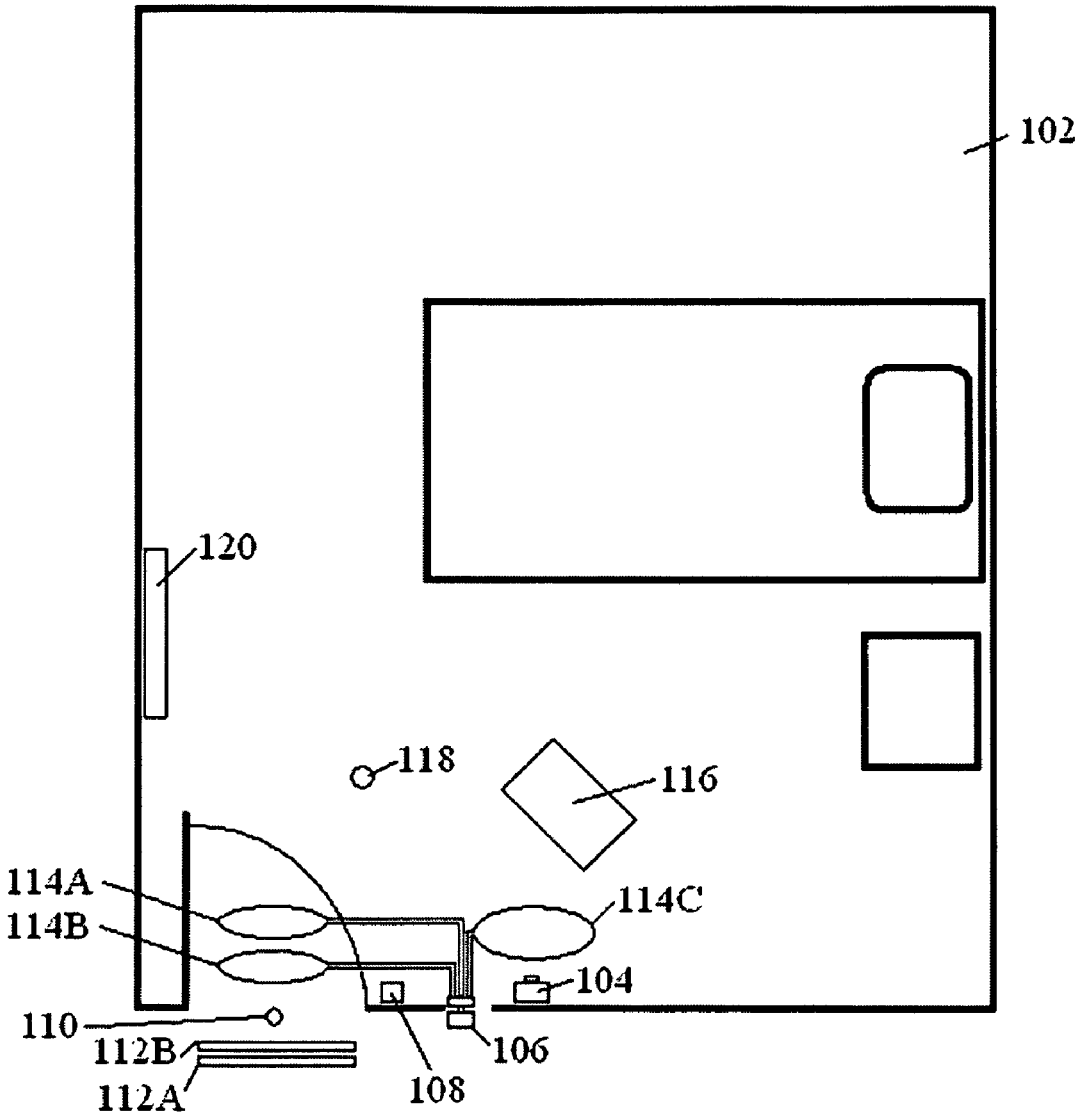
FIG. 1 is a top view of a patient care room showing various components of a hand washing monitoring system according to various embodiments presented herein.

The following detailed description is directed to methods, systems, and computer storage media for monitoring employee and visitor hand washing to prevent the spread of germs. As discussed briefly above, nosocomial infections are a significant concern at hospitals and other patient care facilities around the world. In many cases, nosocomial infections may be prevented through the establishment of and adherence to proper sanitation procedures, including consistent and adequate hand washing.

Utilizing the concepts and technologies described herein, a hand washing monitoring system detects and identifies people entering and exiting a patient care room and provides a warning notification when an employee or visitor has not obtained soap from an instrumented soap dispenser within an allotted amount of time after entering the room. One or more cameras are utilized to capture an image of each person entering the room and in some of the embodiments described below, a second camera image is recorded of each person while washing his or her hands. These images, as will be explained in greater detail below, are used to detect room entry and hand washing, to distinguish between medical personnel, visitors and objects, to identify people who have not washed their hands, and/or to confirm the identities of employees to prevent imposters from posing as medical personnel.

By utilizing the various aspects of the disclosure provided below, room entrants are reminded when they need to wash their hands, and if they do not do so within a pre-determined period of time, the camera image and/or other identifier of each hand washing violator is sent to a supervisor's computer along with details about the time, date, and location of the hand washing violation. Patients are thereby provided with significantly increased protection against nosocomial infections than if the hand washing responsibilities are solely entrusted to each individual that may interact with the patient.

Throughout this disclosure, embodiments are described with respect to a hospital room or other patient care room since a patient care environment receives a tremendous benefit from preventing the spread of germs via consistent hand washing practices. However, it should be understood that the concepts presented herein are equally applicable to restaurant and other food-handling environments, as well as any other application in which preventing the spread of germs is particularly desirable.

In the following detailed description, references are made to the accompanying drawings that form a part hereof, and which are shown by way of illustration, specific embodiments, or examples. Referring now to the drawings, in which like numerals represent like elements through the several figures, different embodiments of a hand washing monitoring system will be described.

FIG. 1 shows an illustrative patient care room 102 equipped with a hand washing monitoring system that includes one or more cameras 108, 110 and 118 coupled to a computing device 106 for capturing images of people who enter the room. This embodiment of a hand washing monitoring system also includes floor detection devices 114A, 114B, and 114C that identify employees plus a computer monitor 120 for displaying camera images and/or text messages that identify each person who has not washed his or her hands within a pre-determined time limit.

The embodiment depicted in FIG. 1 could also include any type, number, and combination of motion sensing devices, cameras, pressure-sensitive floor coverings, distinctive floor areas, electronic sensors, backlit signs, computer monitors, radio frequency identification (RFID) antennas, and other personnel identifying equipment, all coupled to the computing device 106 for detecting and identifying people within the patient care room 102 and for determining if and when people entering or leaving the room obtain soap from a soap dispenser 104.

It should be appreciated that although all of the various communication connections are not illustrated, the computing device 106 may be connected to every electronic component of the hand washing monitoring system described herein via a wired and/or wireless network. The computing device 106 may include a server computer, laptop computer, desktop computer, handheld computing device, or any other suitable computer device operative to perform the data collection, processing, and notification functions described herein. The computing device 106 will be described in further detail below with respect to FIG. 10.

For clarity, the various components of the hand washing monitoring system disclosed herein will be described with respect to an illustrative example in which a person enters the patient care room 102 and lingers without washing his or her hands. As the person enters the patient care room 102, camera 108 and computing device 106 function like a motion sensor to detect the entry, and then computing device 106 activates camera 118 to capture an image of the person. The computing device 106 also attempts to identify the person or persons entering the patient care room 102 via floor detection devices 114A and 114B. The floor detection devices 114A and 114B are depicted in FIG. 1 as loops of conductive wire or foil configured as RFID antennas, which are used to read RFID tags inside employees' shoes or insoles.

Alternatively, the floor detection devices 114A and 114B could be created by mounting an omni-directional barcode reader under a transparent floor covering, which could then read barcodes imprinted on the undersole of each worker's shoes. In another embodiment, the floor detection devices 114A and 114B could read a magnetic strip inside each shoe or insole. In yet another embodiment, the floor covering could contain phototransistors or photodiodes at locations 114A and 114B which detect an intensity modulated Light Emitting Diode (LED) imbedded inside the heel of each worker's shoes. The LED intensity modulations provide an encoded representation of the employee's ID number.

If an entry is detected and the computing device 106 is not able to read an employee or equipment identifier via floor detection devices 114A and/or 114B, then the computing device 106 concludes that a visitor has entered the room. A timer commences upon detecting when any person enters the patient care room 102 and continues until the person washes his or her hands using the instrumented soap dispenser 104. If the person does not wash his or her hands within a pre-determined period of time (e.g. 30 seconds), then the computing device 106 displays a warning message on computer monitor 120 in the patient care room 102, which reminds the person to wash his or her hands.

The warning notification displayed on computer monitor 120 may include the entry image captured by camera 118. Alternatively or additionally, the notification may include any type and quantity of identifying information corresponding to the person if the person is identified as an employee of the patient care facility. It should be understood that the warning notification may include a pre-recorded voice message, an alarm signal, a video clip, lights or other visual indicators, and/or back-lit signs. For example, according to one embodiment in which an employee is identified entering the room without washing his hands within the allotted time, a recording is played that states, "Mr. Johnson, please wash your hands." Simultaneously with the announcement, lights on the soap dispenser 104 illuminate to highlight the hand washing station, and an image of Mr. Johnson along with a textual representation of the audio announcement is displayed on the monitor 120.

If a hand washing violator responds to a warning notification by activating the soap dispenser 104 within a second pre-determined period of time (e.g. 10 seconds), then the warning notification ceases and any captured images of the person may be discarded to alleviate any privacy concerns that stored images might raise.

The computer monitor 120 is primarily used for presenting text messages that warn employees and visitors to wash their hands and for displaying camera images of the hand washing violators. A wide-screen LCD monitor can be rotated 90 degrees and mounted inside a metal frame to make the monitor 120 and supporting frame look like a framed glass window. A window curtain can be hung from a curtain rod to make the "simulated window" look more realistic. During periods between hand washing warnings, the simulated window can be used to playback high-resolution video recordings of outdoor scenes, e.g. a beach or Times Square. The brightness and contrast of the outdoor scene can be automatically changed to represent the actual time of day.

As will be described in more detail below, the soap dispenser 104 includes a sensor or switch that activates when the soap dispenser 104 is triggered to dispense soap. This activation of the sensor or switch informs the computing device 106 that a hand washing is in progress. The person is identified at the soap dispenser 104 and compared to the identifier obtained when the person entered the patient care room 102 to ensure that it is the person that entered the room that is in fact washing his or her hands. If the computing device 106 identifies a hand washing violator, and if the violator does not wash within the pre-determined time limit after a warning notification, then a hand washing violation notice is forwarded to a hospital manager or to a hospital Peer Review Committee. The violation notice includes camera images and other identifiers plus details about the time, date, and location of the hand washing violation.

Each component of the hand washing monitoring system will now be described in greater detail. First, the entry detection and identification process will be discussed. As a person enters the patient care room 102, the computing device 106 detects the entry using any type of motion detection or personnel identifying techniques. According to one embodiment, camera 108 and computing device 106 function like a motion detector. In another embodiment, a different camera 110 mounted near the entryway of the patient care room 102 is focused on at least two stripes 112A and 112B positioned on the floor of the entryway. Depending on the order in which the views of the stripes 112A and 112B are obstructed, it can be determined whether a person is entering or exiting the patient care room 102. For example, if the view of stripe 112A is blocked first, followed by the view of stripe 112B, then it can be determined that the person is entering the patient care room 102.

Figure 2:
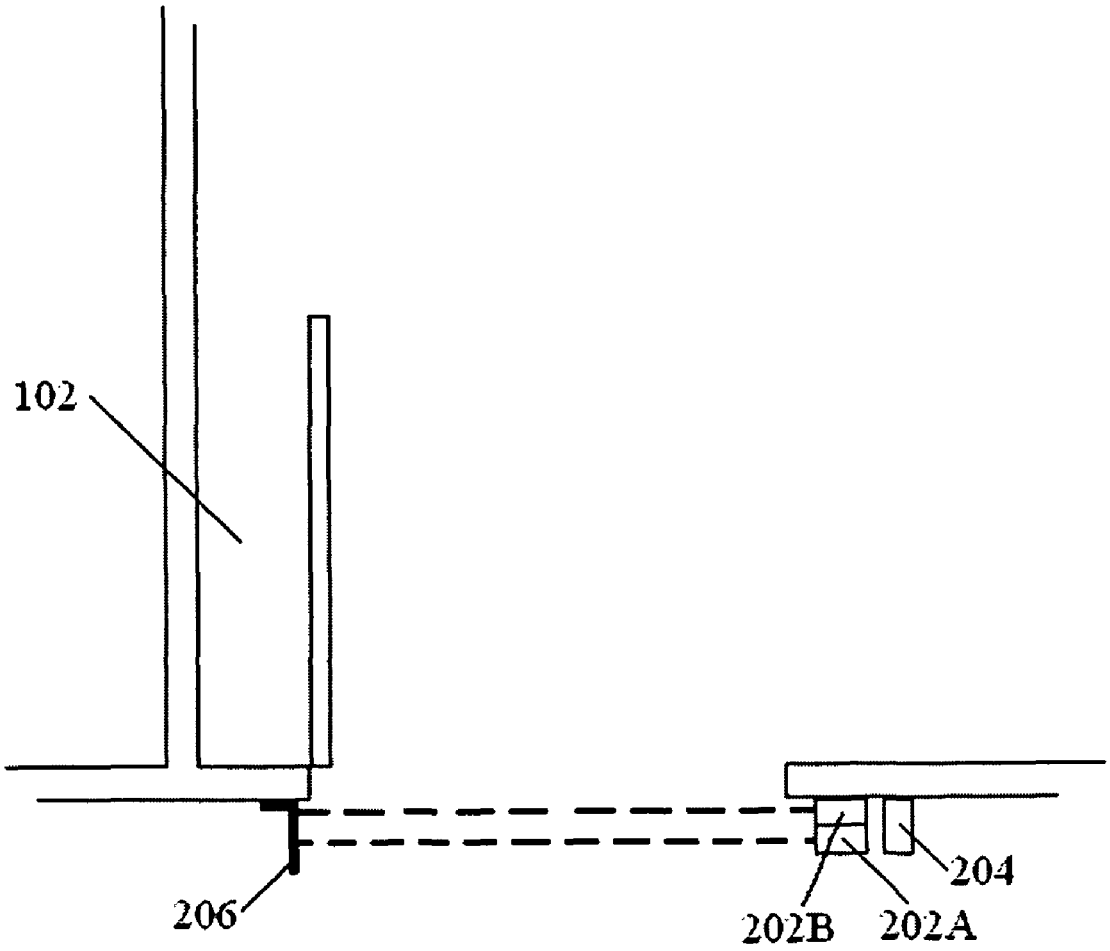
FIG. 2 is a partial top view of a patient care room showing an entry detection mechanism according to various embodiments presented herein.

Yet another embodiment for detecting a person entering and exiting the patient care room 102 is shown in FIG. 2. According to this embodiment, light-emitting diodes (LEDs) 202A and 202B reflect light off of a reflective surface 206 and back to one or more phototransistors 204 positioned above or below the two LED's 202A and 202B. Each LED 202A and 202B are modulated at different square wave frequencies. As a person enters the patient care room 102, the light from the outermost LED 202A is broken first, followed by light from the innermost LED 202B. The reverse is true for a person exiting the patient care room 102.

Returning to FIG. 1, another entry-detection mechanism includes the use of floor detection devices 114A and 114B. According to one embodiment, the floor detection devices 114A and 114B each include a radio frequency identification (RFID) antenna affixed to or within a floor mat, floor covering, or flooring underlayment at a location near the entryway of the patient care room 102. Employees wearing RFID tags or RF transmitters are detected and identified by the RFID antennas within the floor detection devices 114A and 114B as they enter and exit the patient care room 102.

As described above with respect to alternative embodiments, the direction of movement corresponding to entering or exiting the patient care room 102 is determined according to the order in which the floor detection devices 114A and 114B detect a corresponding RFID tag or RF transmitter worn by an employee. A similar floor detection device 114C located in front of the soap dispenser 104 is used to identify each employee while standing in front of the soap dispenser 104. The use of RFID tags and antennas to detect and track movements within a patient room are described in detail in U.S. patent application Ser. No. 11/651,117, filed on Jan. 8, 2007, which is herein incorporated by reference in its entirety.

Employees may wear one or more RFID tags at a location on their body that is detectable by other RFID antennas in the patient room 102. For example, an employee may wear an RFID tag attached to a sock, an ankle bracelet, an insole insert, or a shoe if the corresponding RFID antennas are imbedded inside the floor covering or floor underlayment. It should be appreciated that the RFID antennas are not limited to being positioned within a floor covering. For example, one or more RFID antennas may alternatively be positioned around the entry doorframe. In this alternative embodiment, the RFID tag may be worn or carried anywhere on an employee that would pass within a sufficiently close proximity to the doorframe or antenna location.

It should be noted that the RFID identification accuracy is significantly improved when the plane defined by the RFID tag antenna is approximately parallel to the plane defined by the entryway antenna. For example, an RFID tag affixed to a shirt pocket can be accurately read by an antenna wrapped around the entry doorway when the employee enters the room with a normal upright posture. However, the employee might be able to avoid identification by walking through the doorway sideways or by leaning over while walking through the doorway. If the entry RFID antenna is attached to the floor covering, and an RFID tag is positioned flat inside the sole or insole of employee's shoes, it will be very difficult for an employee to avoid identification.

Each RFID tag transmits an encoded number that identifies an employee or a mobile device such as a wheelchair. Any person or object entering or exiting the patient care room 102 without an RFID tag is identified as a visitor or an untagged object, triggering alternative identification methods discussed below that warn visitors to wash their hands and report each visitor hand washing violation by sending a camera image of each violator to a hospital manager along with details specifying the time, date, and location of the violation.

Figure 3:
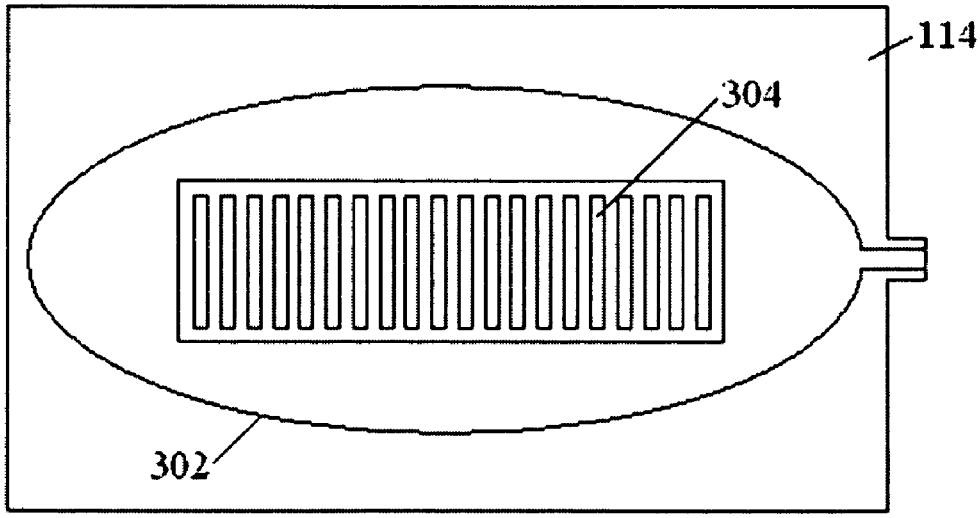
FIG. 3 is a top view of a floor detection device showing an integrated antenna and pressure-sensitive strips for detection of persons according to various embodiments presented herein.

FIG. 3 shows a floor detection device 114 that contains an RFID antenna 302 positioned around an array of pressure-sensitive strips 304. The RFID antenna 302 is configured to detect and read RFID tags inside an employee's insoles or shoes. Each end of the RFID antenna 302 may terminate at a connection terminal that connects the floor detection device 114 to the computing device 106. The RFID antenna 302 may be photo-etched or printed onto a thin circuit board affixed to the floor detection device 114. Alternatively, the RFID antenna 302 may be created by cutting a conductive foil, such as a copper foil, or a conductive screen into the shape of a single or multi-loop spiral antenna. It should be understood that the disclosure presented herein is not limited to the RFID antenna 302 configuration shown and described herein.

The floor detection device 114 may alternatively or additionally include any number of pressure-sensitive strips 304. The pressure-sensitive strips 304 detect compression at any location along each strip. The pressure-sensitive strips 304 are used to detect separate footprints on the surface of the floor detection device 114 to detect the presence of a person at the entryway of the patient care room 102, at the soap dispenser 104, at a location next to the patient's bed, or at a safe zone 116 described below. To determine the direction of movement of a person, the order in which the pressure-sensitive strips 304 are compressed may be determined. If the pressure-sensitive strips detect the footprint of a person and the surrounding RFID antenna does not identify an RFID tag, then it can be assumed that the person is a visitor.

It should be appreciated that the accuracy of the floor detection device 114 in determining the number of footprints and the direction of movement is increased as the number of smaller pressure-sensitive strips 304 is increased. The pressure-sensitive strips 304 may be mounted or printed onto a flexible circuit board with conductive leads printed onto the underside of the circuit board, thereby connecting each pressure-sensitive strip 304 to the connection terminal of the floor detection device 114.

The floor detection device 114 depicted in FIG. 3 can be positioned next to a patient bed to detect when employees and visitors are standing next to the bed. The arrival of an identified employee at a bedside location can be used to monitor the response time of the employee to an alarm code or to a patient request. Employees with slow response times can be identified and reported to a hospital manager, which will encourage employees to become more responsive to patient needs.

Returning to FIG. 1, the process and devices for capturing an image of the person entering the patient care room 102 will be described. Upon entry detection, a camera 118 is used to capture a high-resolution image of the person entering the patient care room 102. The camera 118 may be mounted in an elevated position within the patient care room 102 at a position in which the camera 118 may view the entryway, the soap dispenser 104, and the safe zone 116 (see FIG. 1). One or more lights may be mounted with camera 118 to ensure that there is adequate lighting to capture a clear image.

It should be understood that any number of cameras may be utilized and additional cameras may be positioned at any location in the patient care room 102 in order to detect and identify people according to the disclosure provided herein. For example, the soap dispenser 104 may be mounted near the entryway and may include a built-in camera that is directed toward the door in order to capture images of people entering the room. As will be further described below, the soap dispenser 104 may also include one or more cameras directed at users standing in front of the soap dispenser 104.

As briefly mentioned above with respect to FIG. 1, embodiments described herein provide for a safe zone 116 within the patient care room 102. Some hospitals and patient care facilities allow employees to enter a patient care room 102 without washing their hands if the employees remain a safe distance away from the patient. To allow for this situation, embodiments provide for a badge reader positioned outside of the patient care room 102. An employee may request access to the room 102 without washing by swiping an employee badge within close proximity to the badge reader located just outside the patient room 102. A light or tone indicates when the employee has been granted permission to proceed to the safe zone 116 without washing. There may be situations in which the hospital determines that a patient is too vulnerable to infection and access to the patient care room 102 without hand washing will be denied.

Upon approval to proceed to the safe zone 116, the employee must walk directly to the safe zone 116 within a specified time limit (e.g., 10 seconds). The safe zone 116 may contain a floor detection device 114 similar to the floor detection device depicted in FIG. 3. Alternatively, the safe zone 116 may be delineated using distinctive markings, colors, and/or patterns that are identifiable using camera 118. In this embodiment, the computing device 106 utilizes images from camera 118 to determine whether or not the employee is occupying the safe zone 116.

When an employee is given permission to occupy the room in the safe zone 116 without washing his or her hands, the computing device 106 estimates the time that the employee is in the patient care room 102 and outside of the safe zone 116. If the time spent outside of the safe zone 116 exceeds a pre-determined threshold amount of time, then a notification is provided that the employee needs to wash his or her hands. The computing device 106 determines whether or not the employee obtains an appropriate amount of soap within the pre-determined time limit and reports each hand washing violation to a supervisor's computer.

Camera 108 can be used to detect inward versus outward movements of people and objects that are entering or leaving the room 102. This camera 108 can be also used to capture side view images of each incoming person or object that allow the computing device 106 to distinguish between people and objects by analyzing pattern recognition attributes such as dimensions, colors, and shapes. When an incoming person has been detected, other distinguishing attributes such as height and predominant colors of the person's hair and/or clothing can be utilized to later recognize the person via camera images obtained while obtaining soap from a soap dispenser 104. If the distinguishing attributes identified in the image of the person entering the patient room 102 are present in the subsequent image taken of the person while washing his or her hands, then the computing device 106 concludes that the incoming person has washed his or her hands.

Figure 4:
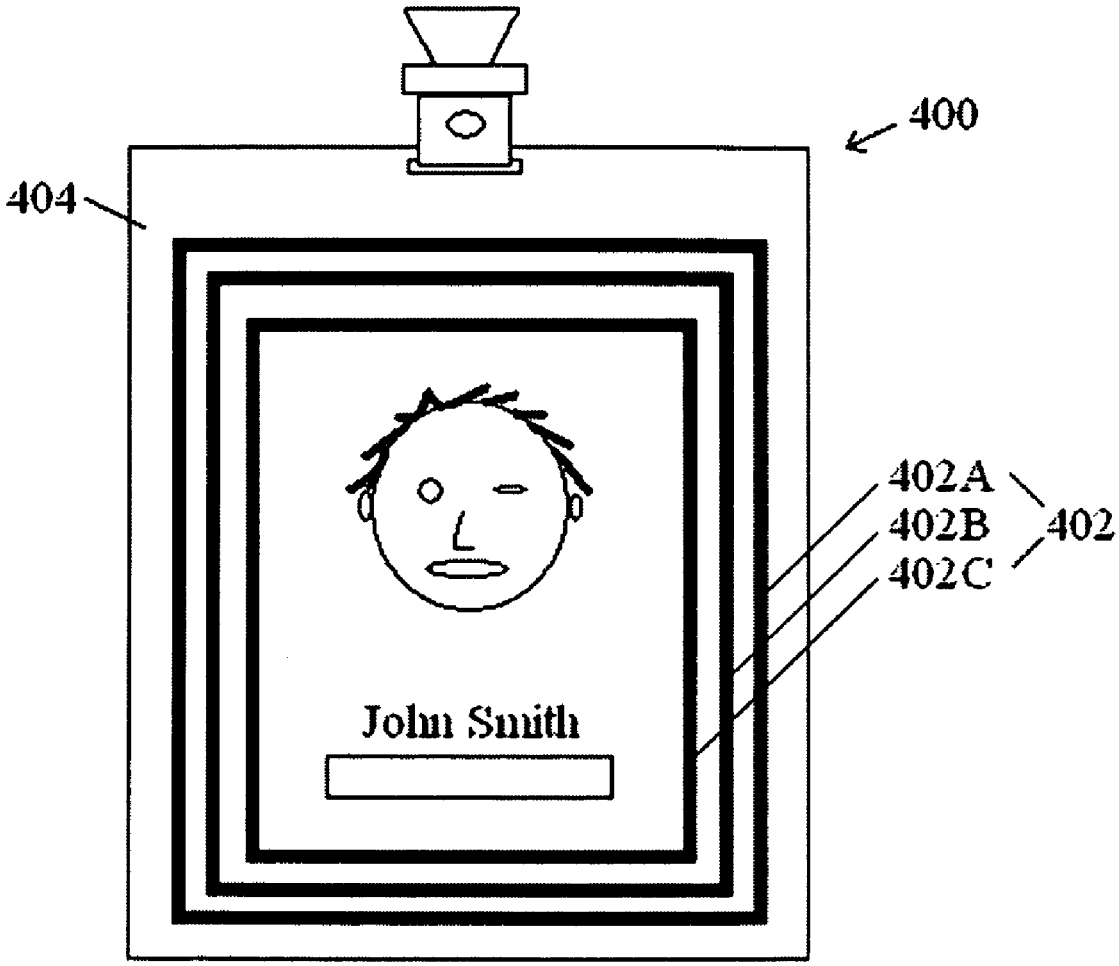
FIG. 4 is a front view of an employee badge showing an encoded employee identifier according to various embodiments presented herein.

According to alternative embodiments, employees may be identified by a variety of other camera imaging methods. For example, FIG. 4 shows an employee badge 400 worn by an employee as an identifier. The employee badge 400 includes distinguishing markings that can be recognized by the computing device 106 in the image taken by camera 118, and the image of the badge can be decoded to determine the employee's identification number. In the example embodiment presented in FIG. 4, the employee badge 400 includes a set of concentric rings 402 printed on a badge that has a distinctive outer border color 404. The outer border color 404 enables the camera 118 and computing device 106 to identify the employee badge from a distance. Each ring 402 may be printed on the employee badge 400 using a color that represents a particular number in a particular place value.

In the example shown, the ring 402A may be printed in red and represent a digit in the hundreds place of a three digit employee identification number. The ring 402B may be printed in black and represent a digit in the tens place of the employee identification number. The ring 402C may be printed in yellow and represent a digit in the ones place of the employee identification number. The following colors may be used to represent the numbers shown:

| | |
|---|---|
| Black = | 0 |
| Brown = | 1 |
| Red = | 2 |
| Orange = | 3 |
| Yellow = | 4 |
| Green = | 5 |
| Blue = | 6 |
| Purple = | 7 |
| Silver = | 8 |
| Gold = | 9 |

Given the above table of colors and corresponding numbers, the employee identification number corresponding to the employee badge 400 shown in FIG. 4 would be number 204. This result is arrived at since the red ring represents the number 2 in the hundreds place of the three digit employee identification number, the black ring represents the number 0 in the tens place, and the yellow ring represents the number 4 in the ones place. The computing device 106 may then look up employee identification number 204 to determine that the person entering the patient care room 102 is employee John Smith. The employee's name and photograph retrieved from a database storing employee information may then be used in a hand washing warning notifications. If the employee fails to wash his or her hands after the warning notification, then the failure to follow sanitation protocol may be reported with the employee ID number to a supervisor or Peer Review Committee.

It should be understood that any number of concentric rings may be used to encode employee identification numbers and that any color may be used to represent any number. It should also be understood that this encoding and decoding technique that allows for an identification of an employee using distinguishing attributes of an employee badge 400, is not limited to the use of color-coded concentric rings. Rather, any visually distinguishing attributes that may be assigned digits in various place values of an employee identification number may be used.

Figure 5A:
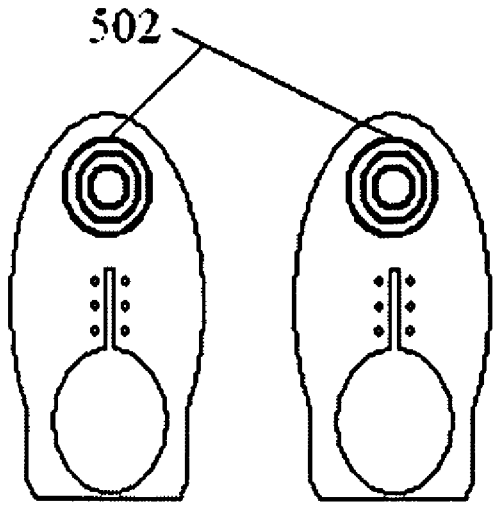
FIGS. 5A and 5B are top views of alternative encoded employee identifiers according to various embodiments presented herein.
Figure 5B:
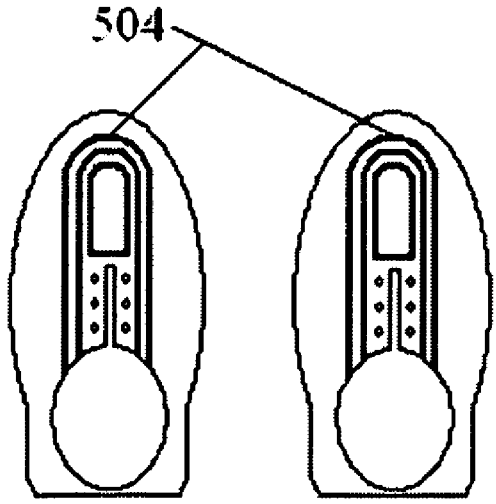

FIGS. 5A and 5B show alternative embodiments in which an employee's identification number is encoded as color-coded labels 502 and 504 on each shoe. The color-coded labels 502 and 504 on each shoe are employee identifiers that utilize color-coded rings and lines to encode a number that is unique to the person associated with the label in a similar manner as the concentric rings 402 on an employee badge 400 described above with respect to FIG. 4. The color-coded labels 502 and 504 may be affixed or printed on a top surface of an employee's shoes as shown, or printed on any other article of clothing.

Figure 6:
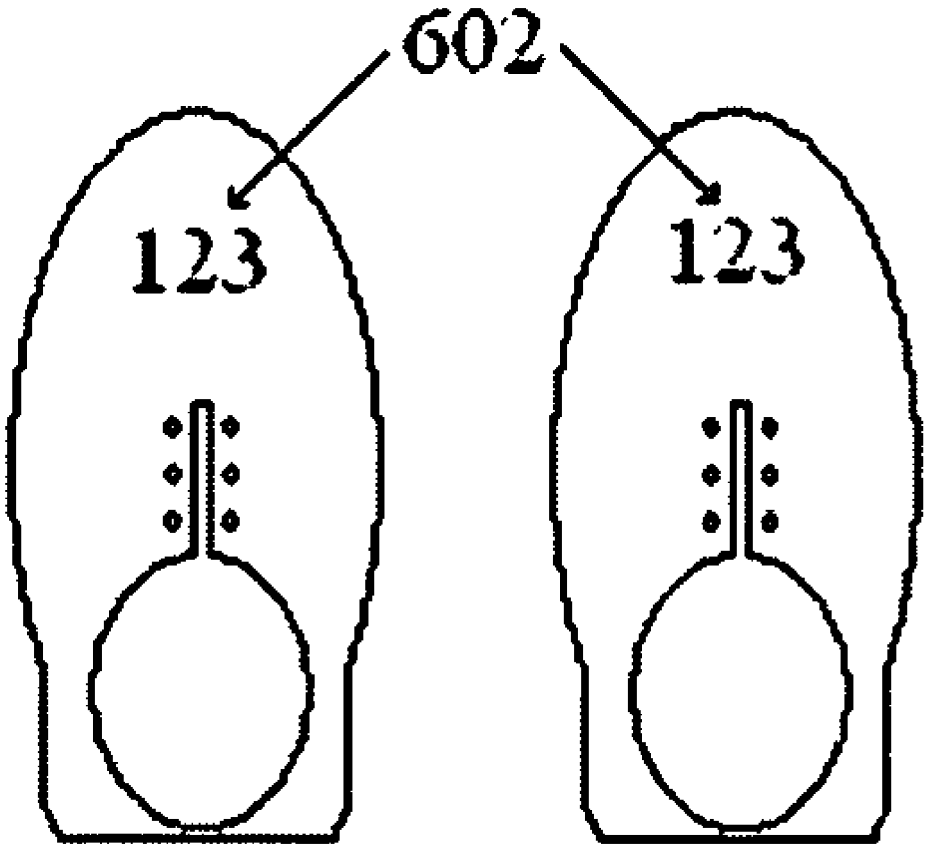
FIG. 6 is a top view of an alternative employee identifier according to various embodiments presented herein.

It should be appreciated that according to various embodiments, the color-coded labels 502 and 504 may be added to a shoe or other article of clothing, or may be incorporated into the design of the shoe or other article of clothing. FIG. 6 shows an embodiment in which the employee's identification number 602 is imprinted onto each shoe so that when the camera 118 photographs the shoe, the computer 106 may utilize character recognition software to read the number, or alternatively, an image of either shoe may be sent to a supervisor or other employee that is able to identify the employee associated with the identification number.

Figure 7:
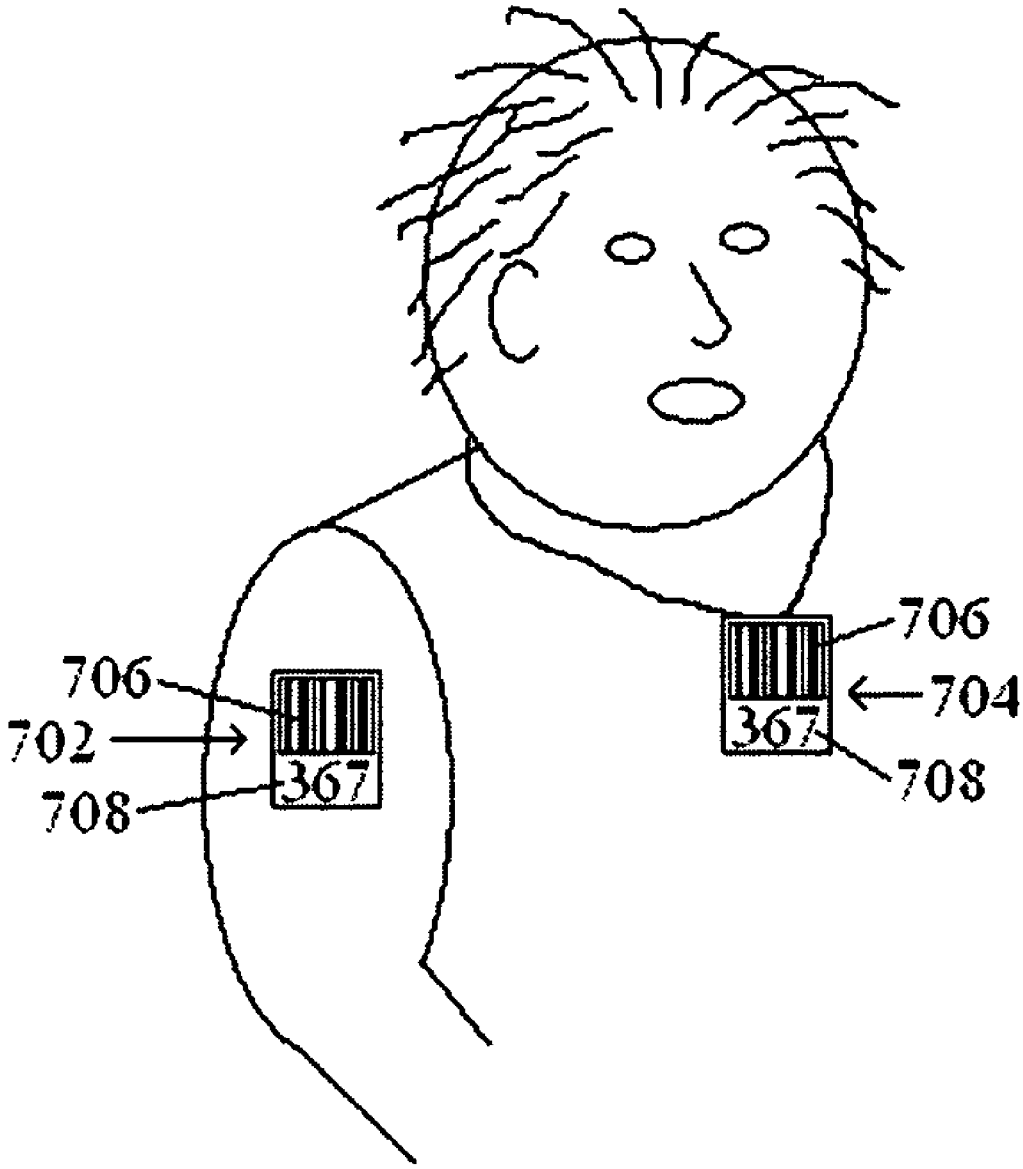
FIG. 7 is a perspective view of an employee wearing alternative employee identifiers according to various embodiments presented herein.

FIG. 7 shows an employee badge 706 that is clipped, banded, or otherwise attached to a shirtsleeve or arm of an employee. A similar employee badge 704 may additionally or alternatively be worn on the front side of an employee using a lanyard, clips, pins, or any other means for attaching the badge 704. The employee badges 702 and 704 contain a large barcode 706 or color-coded label and a corresponding printed employee identification number 708. It should be clear from the examples given above that any number of employee identifiers may be used in conjunction with the camera 118 and computing device 106 to enable the identification of an employee while entering the patient care room 102 and while activating the soap dispenser 104.

The computing device 106 must detect when employees and visitors have washed their hands. According to various embodiments, a determination is made that someone is washing when the soap dispenser 104 is activated. Activating the soap dispenser 104 can be detected using a variety of simple sensor devices and electronics, for example by using an electrical contact switch attached to the soap release lever arm or by using a light beam that is blocked when the lever arm is depressed.

Figure 8:
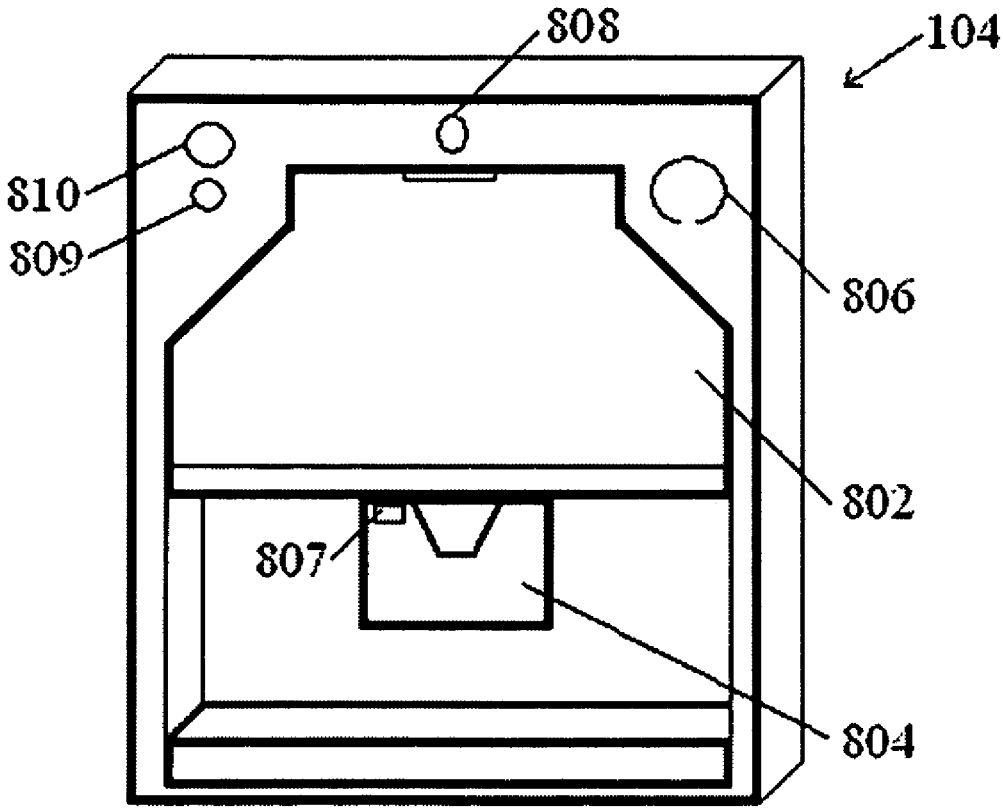
FIG. 8 is a perspective view of a soap dispenser according to various embodiments presented herein.

FIG. 8 shows an illustrative soap dispenser 104. The soap dispenser 104 includes a soap container 802 for storing a soap or disinfectant product and a soap release lever arm 804 for dispensing soap from a nozzle below the soap container 802. An electrical contact switch can be attached to the soap release lever arm 804 to detect when the lever arm 804 is depressed. In an alternative embodiment, an LED light source is square-wave modulated and projected to a phototransistor along the backside of the lever arm 804. Depressing the lever arm 804 blocks the LED light beam, and the phototransistor detects when this occurs.

The mechanical soap release lever 804 may be replaced by a proximity sensor that detects the proximity of a human hand under the sensor, which then actuates an electrical valve to release soap from the soap container 802. The proximity sensor may be monitored by the computing device 106 to verify that a person's hand remains under the nozzle of the soap container 802 for a minimum period of time to ensure that an adequate quantity of soap is dispensed.

Each time soap is dispensed, the computing device 106 attempts to identify the person activating the soap dispenser 104. If the person washing his or her hands is the person that recently entered the room and triggered the described monitoring process, then the timer is reset and the person's image and any other identifier information may be discarded. If the person washing his or her hands is not the person that recently entered the patient care room 102, then the person that entered the room is still required to wash his or her hands, so the monitoring and notification process continues.

If more than one person enters the patient room 102 at the same approximate time, then each person must be tracked until the number of activations of the soap dispenser 104 equals the number of people that entered the room. If the people using the soap dispenser 104 cannot be identified and the number of people using the soap dispenser 104 is less than the number of people that entered the patient room 102, then all of the people will receive a group warning notifications until the correct number of hand washings have occurred. If the correct number of hand washings do not occur within the pre-determined time limit after the warning notification, then the entry images of all of the people are sent to a supervisor's computer as a collection of photographs.

Several different employee identification devices and methods are described above. The same devices and methods used to identify employees entering the patient care room 102 may be also used to identify employees at the soap-dispenser 104. For example, looking at FIG. 1 again, one embodiment utilizes an RFID floor antenna within the floor detection device 114C located in front of the soap-dispenser 104, i.e. the same way that RFID floor antennas 114A and 114B are used to read employee RFID tags at the entryway.

Returning to FIG. 8, in an alternative embodiment, the soap dispenser 104 may include a short-range RFID badge reader 805 that allows employees to register their hand washings. Once the computing device identifies an RFID badge corresponding to an employee that was previously identified entering the patient care room 102, then the employee's entry image captured by camera 118 may be discarded.

Some hospitals or patients may object to using cameras as a part of the hand washing monitoring system. In an alternative embodiment of the monitoring system, no entry cameras 108, 110, or 118 are used. When an employee enters the patient care room 102, RFID antennas 114A and 114B detect the direction of motion (i.e. entering versus leaving), and these antennas also read the employee's RFID tag. Employees are identified at the soap dispenser 104 by an RFID badge reader 806 built into the soap dispenser 104, or by an RFID floor antenna 114C in front of the soap dispenser 104, or by an RFID antenna mounted inside the wall next to the soap dispenser 104.

If an identified employee does not wash his or her hands within a pre-determined time limit, the computing device 106 can be programmed to automatically retrieve the employee's name and prior camera image from personnel records. The employee's name and/or prior camera image may be then displayed on monitor 120 as a part of the warning notification. If the employee does not wash his or her hands within a pre-determined time limit after the warning notification, the employee's identification number is sent to a supervisor's computer, along with the time, date, and location of the hand washing violation. If an employee or visiting doctor refuses to wear an RFID tag, then the no-camera embodiment of the monitoring system will not be able to identify the untagged employee or visiting doctor if they commit a hand washing violations. Camera 118 is a very important part of the hand washing monitoring system for hospitals since it is difficult to force all employees and visitors to wear RFID tags.

In restaurant applications of the hand washing monitor, all employees can be forced to wear insoles or shoes containing RFID tags, and there are no visitors permitted in the work areas. Certain areas such as restrooms, cash registers, storage rooms, and other locations are classified as "contaminated." Employees are expected to wash their hands when exposed to these areas prior to coming into contact with food preparation areas or other clean areas. RFID tags may be affixed to each employee's insoles or shoes and used in conjunction with RFID floor antennas to detect and identify employees as they enter and leave a contaminated area, when they are standing in front of a soap dispenser 104, and when they are moving into a clean area. An electrical switch inside each soap dispenser 104 detects when an appropriate amount of soap is dispensed. When hand washing is not performed, or performed improperly, an RF addressable buzzer, clapper, vibrator, or beeper that is clipped to the employee's uniform provides a notification to the employee that proper hand washing is required.

An RFID monitoring system seems ideal for restaurants, but some hospitals are concerned that RFID may interfere with wireless diagnostic equipment. A no-RFID version of the hand washing monitoring system is possible using only one camera 118, strategically positioned at an elevated position to detect the direction of motion at the entryway (i.e. entering versus leaving), to capture a camera image of each entering person, and to detect whether a person entering the room 102 walks directly to the soap dispenser 104. The instrumented soap dispenser 104 detects when and how much soap is dispensed, which reveals whether an acceptable hand washing has occurred. The same camera 118 can also detect whether the entering person walks directly to the safe zone 116 without washing and later leaves via a direct path to the entryway. If the entering person (i.e. employee, visitor or visiting doctor) does not walk directly to the soap dispenser 104 and wash his or her hands, or walk directly to/from the safe zone 116, then the camera image captured at the entryway may be sent to a supervisor's computer along with the time, date, and location of the hand washing violation. Each time a hand washing violation is detected, the monitor 120 can be used to provide a warning notification, displaying the camera image of the hand washing violator.

In the above no-RFID embodiment of the hand washing monitor, an employee or visiting doctor might cover their face while entering the room, expecting that the image captured by camera 118 would not reveal their identity. The camera image of each hand washing violator displayed on monitor 120 will allow the patient to identify when an incoming person has attempted to avoid identification. It is also likely that an imposter would cover his or her face or avoid facing camera 118 while entering the room 102. If the hospital or patient is concerned about identifying imposters, the entry image of each incoming person can be displayed on the monitor 120, along with a text message encouraging each incoming person to wash his or her hands.

In the no-RFID embodiment of the hand washing monitor, biometrics can be used to identify employees and imposters. For example, hand geometry can be measured while obtaining soap from the soap dispenser 104. To enable this feature, each employee is required to obtain soap by inserting their hand into the soap dispenser 104 with fully extended fingers. Graphical features of the palm, fingers, and/or knuckles are detected by camera 807, which provide an accurate biometric for identifying each employee. A light or audible notification may be used to inform the employee that their identity has been verified while obtaining soap. If the hospital or patient is concerned about identifying medical imposters, a text message and camera image can be displayed on monitor 120 each time an incoming person has washed his or her hands but has not been identified via their hand geometry. In a similar biometric embodiment of the hand washing monitor, a fingerprint reader 808 can be built into or positioned next to the soap dispenser 104 to identify employees when they are obtaining soap.

The soap dispenser 104 may include a camera 809 that is used in conjunction with the computing device 106 to identify distinguishing attributes in the person that activated the soap dispenser 104 or to read color-coded badges 400. As discussed above, the distinguishing attributes may include, but are not limited to a height estimate, distinguishing facial features, distinctive hair color or style, and distinctive colors and/or patterns in the clothing worn by the person. When a visitor activates the soap dispenser 104, the computing device 106 searches for distinguishing attributes identified from camera 118 images captured at the entryway of the room 102. If the distinguishing attributes from an entry image are also found in the image of the person washing his or her hands, then the computing device 106 concludes that the person at the soap dispenser 104 is the same person that was imaged at the entryway.

If employees are wearing identification shoes, as exemplified in FIGURES 5A, 5B and 6, then camera 809 would need to be positioned at the bottom edge of the soap dispenser 104 or mounted on the wall below the soap dispenser 104 and would need to be focused downward. It would be also advisable to use camera 108 in FIG. 1 to image employees' shoes at the entryway, i.e. focusing camera 108 downward onto the shoes of each incoming and outgoing person.

FIG. 1 does not show a shoe camera 108 next to the bed, but it would be possible to use a shoe camera 108 next to the bed to identify employees while they are standing next to the bed and wearing identification markings on their shoes 502, 504 or 602. This same shoe camera 108 next to the bed could also detect when the patient is getting out of the bed and when a large object falls and remains on the floor next to the bed. The latter situation would be interpreted and reported by the computing device 106 as a possible patient fall.

The shoe cameras 108 described above could be also used in restaurants to identify workers when they are entering and leaving a dirty area and when they are obtaining soap from a soap dispenser similar to FIG. 8. The only sensors required for the restaurant hand washing monitoring system would be the shoe cameras 108 positioned at the entryways of dirty areas (e.g. restrooms), a similar shoe camera 108 positioned at each soap dispenser 104, and a sensor or contact switch built-into each soap dispenser that detects when and how long the soap release lever arm 804 has been depressed.

The soap dispenser 104 may additionally include one or more lights 810 or other visual indicators. Depending on the color, brightness, or flashing pattern of the light 810, it may be used for any type of notification purposes. Examples include but are not limited to highlighting the soap dispenser 104 upon detecting an entry into the patient care room 102, indicating that an identity comparison of the person washing his hands to a person entering the patient care room 102 has been successfully completed, indicating that the person attempting to wash his or her hands has or has not dispensed a proper quantity of soap, indicating that sufficient washing time has been completed prior to rinsing, indicating a potential imposter, illuminating a person utilizing the soap dispenser 104 so that the camera 809 can record a high-quality image, or any combination thereof.

In an alternative embodiment, the sensor or electrical switch connected to the soap release lever 804 may be coupled to any number and type of actuators within a room to prevent the use or operation of a device until a soap dispenser 104 is activated. For example, during non-emergency periods, opening the entry door of a room can be linked to the soap release lever 804, so that a person must wash his or her hands using a soap dispenser 104 mounted outside the room before the door is released and allowed to be opened by leaning against the door. Similarly, a soap dispenser 104 mounted inside the room may release the exit door, thereby requiring the person to wash his or her hands prior to leaving the room.

Figure 9:
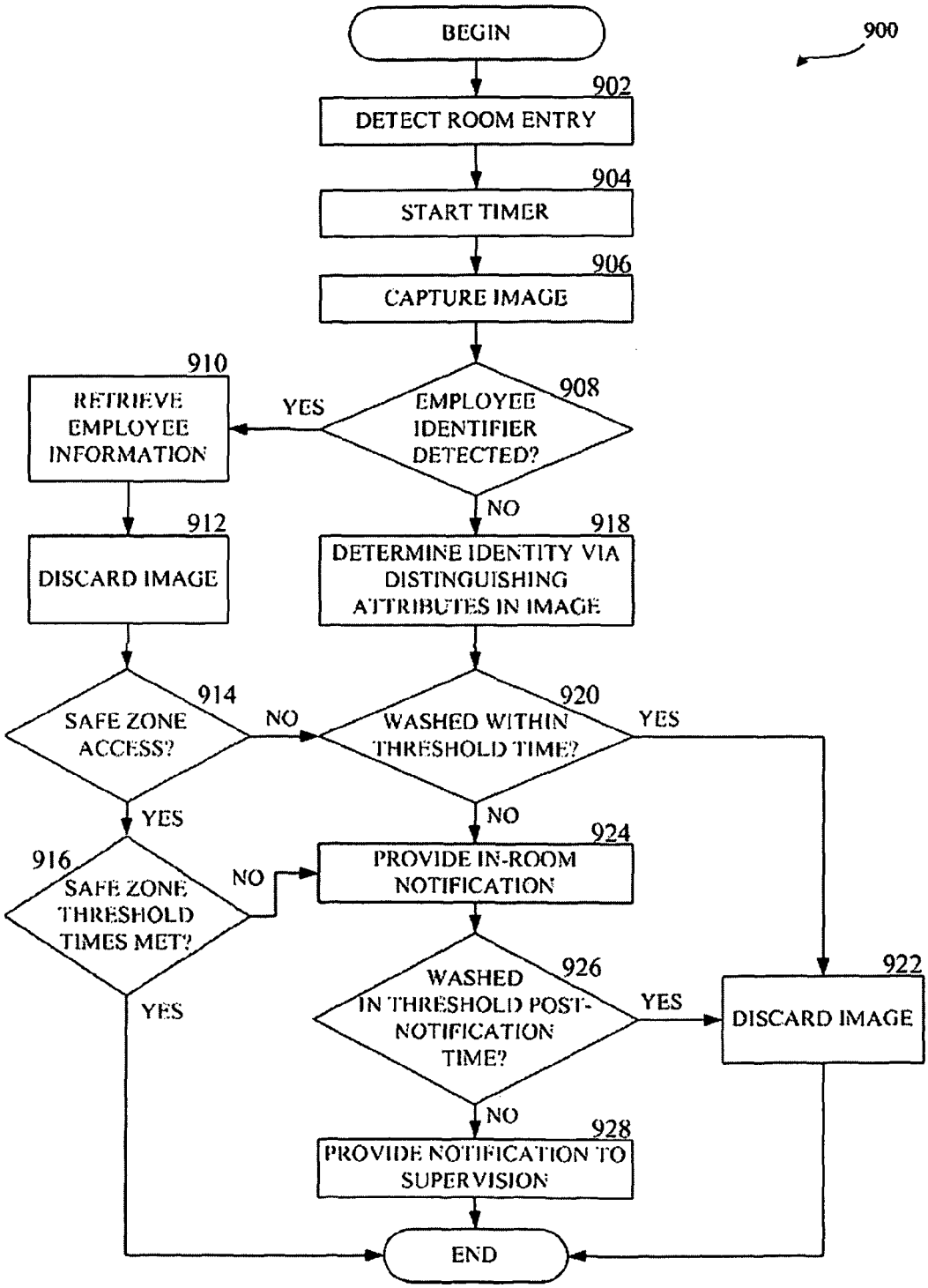
FIG. 9 is a flow diagram illustrating a method for monitoring hand washing according to various embodiments presented herein.

Turning now to FIG. 9, an illustrative routine 900 for monitoring hand washing will now be described in detail. It should be appreciated that the logical operations described herein are implemented (1) as a sequence of computer implemented acts or program modules running on a computing device 106 and/or (2) as interconnected machine logic circuits or circuit modules within the computing device 106. For simplicity, the operations are described as being performed by a hand washing monitoring application executing on the computing device 106, but it should be appreciated that any number of applications or modules executing on the computing device 106 may be utilized to perform the described operations. The computing device 106 will be described below with respect to FIG. 10.

The implementation of the logical operations described herein is a matter of choice dependent on the performance and other requirements of the computing system. Accordingly, the logical operations described herein are referred to variously as states operations, structural devices, acts, or modules. These operations, structural devices, acts and modules may be implemented in software, in firmware, in special purpose digital logic, and any combination thereof. It should also be appreciated that more or fewer operations may be performed than shown in the figures and described herein. These operations may also be performed in a different order than those described herein.

The routine 900 begins at operation 902, where the hand washing monitoring application detects a person entering the patient care room 102 using any of the entry detection methods discussed above. At operation 904, a timer is started in order to track the amount of time between room entry and hand washing. From operation 904, the routine 900 continues to operation 906, where the hand washing monitoring application captures an image of the person entering the patient care room 102 using the camera 118 or any other camera within the patient care room 102. The routine continues to operation 908, where a determination is made as to whether an employee identifier has been detected. As discussed above, according to various embodiments, an employee identifier may be an RFID tag or any type of encoded pattern printed or incorporated into the employee's clothing.

If an employee identifier is detected, then the routine 900 proceeds to operation 910, where the hand washing monitoring application retrieves employee information corresponding to the employee from personnel files or a database of employee information. At operation 912, the image of the employee taken upon entry into the patient care room 102 is discarded and the routine 900 continues to operation 914, where it is determined whether the employee requested entry to the safe zone 116 within the patient care room 102 without requiring hand washing. If the employee is not requesting access to the safe zone 116 or is denied access, the routine 900 proceeds to operation 920 and continues as described below. However, if the employee is requesting access to the safe zone 116 and is granted access, the routine 900 continues from operation 914 to operation 916, where the hand washing monitoring application monitors the employee's location and travel times to determine whether any predetermined threshold travel time is violated. If the threshold times are complied with, then the routine 900 ends. However, if the threshold times are not complied with, then the routine 900 proceeds to operation 924 and continues as described below.

Returning to operation 908, if an employee identifier is not detected upon entry into the patient care room 102, then the routine 900 proceeds to operation 918, where the hand washing monitoring application determines the identity of the visitor for purposes of comparison at the soap dispenser 104 and for notification if the visitor fails to wash his hands within the allotted time. The identity of the visitor includes identified distinguishing attributes of the person's physical features, as well as distinctive clothing features. From operation 918, the routine 900 continues to operation 920, where the hand washing monitoring application determines whether the person activated the soap dispenser 104 within the threshold period of time. If the person did wash his hands in the allotted time period, then the routine proceeds to operation 922, where the entry image is discarded and the routine 900 ends.

However, if at operation 920, it is determined that the person did not wash his hands within the threshold period of time, then the routine 900 proceeds to operation 924 and an in-room notification is provided on the monitor 120. As discussed above, the notification may include the entry image of the person and may alternatively or additionally include an audible announcement within the room. From operation 924, the routine 900 continues to operation 926, where the hand washing monitoring application determines whether the person activated the soap dispenser 104 within a post-notification threshold period of time after the notification was provided. If so, then the routine proceeds to operation 922, where the entry image is discarded and the routine 900 ends. However, if the person did not wash his hands within the allotted time after the first notification was provided, then the routine 900 proceeds from operation 926 to operation 928, where a second notification is provided to a supervisory entity such as a Peer Review Committee or on-duty supervisor for further action. From operation 928, the routine 900 ends.

Figure 10:
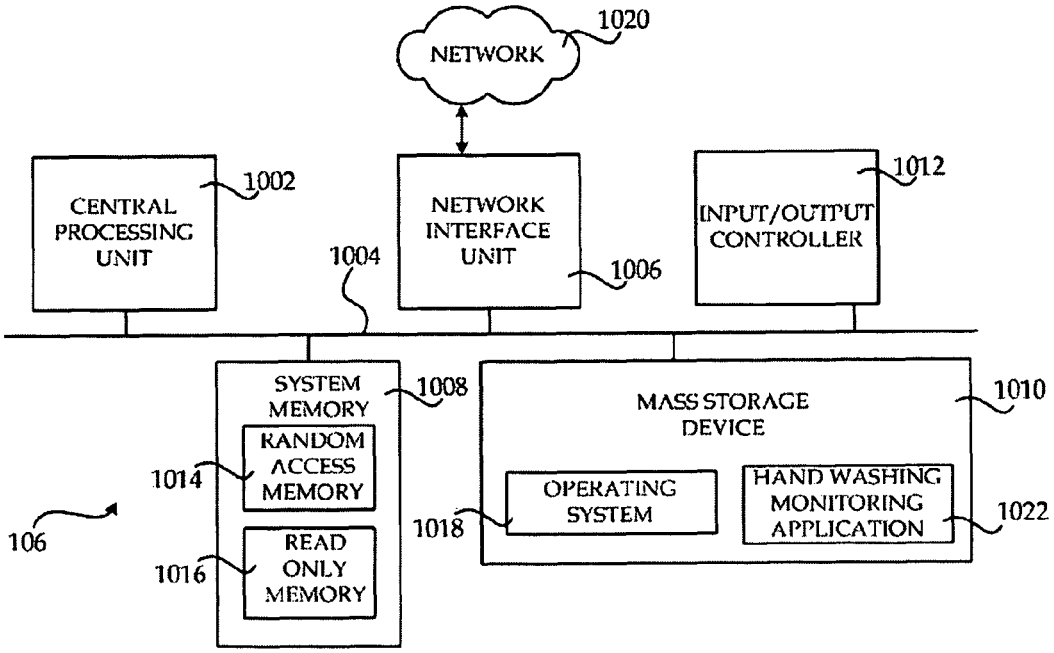
FIG. 10 is a computer architecture diagram showing an illustrative computer hardware and software architecture for a computing system capable of implementing aspects of the embodiments presented herein.

FIG. 10 shows an illustrative computer architecture for a computing device 106 capable of executing the software components described herein for monitoring hand washing in the manner presented above. The computer architecture shown in FIG. 10 illustrates a conventional desktop, laptop, or server computer and may be utilized to execute any aspects of the methods presented herein. As described above, the computing device 106 may be a communicatively linked to the various components of a hand washing monitoring system via a wired or wireless network 1020.

The computer architecture shown in FIG. 10 includes a central processing unit 1002 (CPU), a system memory 1008, including a random access memory 1014 (RAM) and a read-only memory (ROM) 1016, and a system bus 1004 that couples the memory to the CPU 1002. A basic input/output system containing the basic routines that help to transfer information between elements within the computing device 106, such as during startup, is stored in the ROM 1016. The computing device 106 further includes a mass storage device 1010 for storing an operating system 1018, application programs, and other program modules, which are described in greater detail herein.

The mass storage device 1010 is connected to the CPU 1002 through a mass storage controller (not shown) connected to the bus 1004. The mass storage device 1010 and its associated computer-readable media provide non-volatile storage for the computing device 106. Although the description of computer-readable media contained herein refers to a mass storage device, such as a hard disk or CD-ROM drive, it should be appreciated by those skilled in the art that computer-readable media can be any available computer storage media that can be accessed by the computing device 106.

By way of example, and not limitation, computer-storage media may include volatile and non-volatile, removable and non-removable media implemented in any method or technology for storage of information such as computer-readable instructions, data structures, program modules or other data. For example, computer-storage media includes, but is not limited to, RAM, ROM, EPROM, EEPROM, flash memory or other solid state memory technology, CD-ROM, digital versatile disks (DVD), HD-DVD, BLU-RAY, or other optical storage, magnetic cassettes, magnetic tape, magnetic disk storage or other magnetic storage devices, or any other medium which can be used to store the desired information and which can be accessed by the computing device 106.

According to various embodiments, the computing device 106 may operate in a networked environment using logical connections to remote computers and system components through a network such as the network 1020. The computing device 106 may connect to the network 1020 through a network interface unit 1006 connected to the bus 1004. It should be appreciated that the network interface unit 1006 may also be utilized to connect to other types of networks and remote computer systems. The computing device 106 may also include an input/output controller 1012 for receiving and processing input from a number of other devices, including a keyboard, mouse, or electronic stylus (not shown in FIG. 10). Similarly, an input/output controller may provide output to a display screen, a printer, or other type of output device (also not shown in FIG. 10).

As mentioned briefly above, a number of program modules and data files may be stored in the mass storage device 1010 and RAM 1014 of the computing device 106, including an operating system 1018 suitable for controlling the operation of a networked desktop, laptop, or server computer. The mass storage device 1010 and RAM 1014 may also store one or more program modules. In particular, the mass storage device 1010 and the RAM 1014 may store the hand washing monitoring application that is operative to perform the operations described above. The mass storage device 1010 and the RAM 1014 may also store other types of program modules.

The subject matter described above is provided by way of illustration only and should not be construed as limiting. Various modifications and changes may be made to the subject matter described herein without following the example embodiments and applications illustrated and described, and without departing from the true spirit and scope of the present invention, which is set forth in the following claims.

What is claimed is:

1. A method for monitoring hand washing within a room, the method comprising:

detecting a person entering the room;

capturing an image of the person that entered the room;

detecting an employee identifier, wherein determining the identity of the person that entered the room using the image of the person or the employee identifier comprises retrieving employee identification information corresponding to the person that entered the room using the employee identifier;

determining an identity of the person that entered the room using the image of the person or the employee identifier;

deleting the image of the person that entered the room after determining the identity of the person as an employee using the employee identifier and corresponding employee identification information;

determining whether the person activates a soap dispenser within a threshold period of time; and providing a notification of a failure to wash hands if the person does not activate the soap dispenser within the threshold period of time, the notification comprising the identity of the person.

2. The method of claim 1, wherein capturing an image of the person that entered the room comprises distinguishing the person from an object entering the room according to physical attributes associated with the person or the object and capturing the image of the person for identification.

3. The method of claim 1, wherein the employee identifier comprises at least one of a radio-frequency identification (RFID) tag and a radio-frequency transmitter.

4. The method of claim 1, wherein the employee identifier comprises an identifying attribute worn by the person that identifies the person as an employee.

5. The method of claim 1, wherein the employee identifier comprises at least one of an RFID tag, a radio-frequency transmitter and a biometric identifier, the method further comprising:

retrieving an image or biometric identifier of an employee associated with the employee identifier;

comparing the image or the biometric identifier of the person to the image or biometric identifier of the employee to determine whether the person is the employee associated with the employee identifier; and if the person is not the employee associated with the employee identifier, providing an imposter notification that indicates that the person is not the employee associated with the employee identifier.

6. A method for monitoring hand washing within a room, the method comprising:

detecting a person entering the room;

capturing an image of the person that entered the room;

determining an identity of the person that entered the room using the image of the person or an employee identifier;

determining whether the person activates a soap dispenser within a threshold period of time;

starting a timer for determining whether the person entering the room activates the soap dispenser within the threshold period of time;

detecting an activation of the soap dispenser;

determining an identity of a person activating the soap dispenser;

comparing the identity of the person activating the soap dispenser to the identity of the person that entered the room to determine if the person activating the soap dispenser is the person that entered the room;

in response to determining that the person that activated the soap dispenser is the person that entered the room, resetting the timer; and providing a notification of a failure to wash hands if the person does not activate the soap dispenser within the threshold period of time, the notification comprising the identity of the person.

7. The method of claim 6, wherein determining the identity of the person activating the soap dispenser comprises detecting an employee identifier and determining the identity of the person activating the soap dispenser from the employee identifier.

8. The method of claim 6, wherein determining the identity of the person entering the room using the image of the person or an employee identifier comprises selecting at least one distinguishing attribute associated with the image, wherein determining the identity of the person activating the soap dispenser comprises recording an image of a person activating the soap dispenser, and wherein comparing the identity of the person activating the soap dispenser to the identity of the person that entered the room to determine if the person activating the soap dispenser is the person that entered the room comprises determining whether the image of the person activating the soap dispenser comprises the at least one distinguishing attribute associated with the image of the person entering the room.

9. The method of claim 1, wherein determining whether the person activates the soap dispenser within the threshold period of time comprises determining whether an electrical or optical switch corresponding to the soap dispenser has been activated.

10. The method of claim 1, further comprising:

determining whether the person activates the soap dispenser within a post-notification threshold period of time after the notification has been provided; and providing the notification to a facility employee if the person does not activate the soap dispenser within the post-notification threshold period of time.

11. A method for monitoring hand washing within a room, the method comprising:

detecting a person entering the room;

capturing an image of the person that entered the room;

determining an identity of the person that entered the room using the image of the person or an employee identifier;

determining whether the person activates a soap dispenser within a threshold period of time;

determining that the person is authorized to occupy a designated safe zone within the room without activating the soap dispenser;

determining a travel time corresponding to a time that the person takes to arrive at the designated safe zone after entering the room or to exit the room after leaving the designated safe zone;

determining whether the travel time exceeds a threshold travel time, wherein the threshold period of time for activating the soap dispenser comprises a pre-determined amount of time in excess of the threshold travel time; and providing a notification of a failure to wash hands if the person does not activate the soap dispenser within the threshold period of time, the notification comprising the identity of the person.

12. The method of claim 11, wherein the designated safe zone comprises a distinctive identifier on the floor of the patient care room that is identifiable within an image created by an imaging device positioned with an elevated view of an entry doorway of the room, the soap dispenser, and the designated safe zone.

13. The method of claim 12, wherein the distinctive identifier comprises at least one of a floor marking, a floor covering, a floor color, and a floor pattern configured to distinguish the safe zone from adjacent floor space.

14. The method of claim 12, wherein determining that the person is authorized to occupy the designated safe zone within the room without activating the soap dispenser comprises:

receiving employee identification data from at least one of an RFID tag and a radio-frequency transmitter identifying the person as an employee requesting entry to the room; and retrieving employee authorization utilizing the employee identification data from the at least one of an RFID tag and a radio-frequency transmitter.

15. A hand washing monitoring system comprising:

an entry-detection mechanism operative to detect an entry of a person into a room, wherein the entry-detection mechanism comprises a motion detection device configured to detect movement through a door of the room;

at least one identification mechanism operative to identify the person entering the room and to identify a person activating a soap dispenser within the room, wherein the at least one identification mechanism is operative to distinguish between facility employees and visitors;

a hand washing detection mechanism operative to determine whether the soap dispenser has been activated; and a monitoring mechanism operative to utilize data from the entry-detection mechanism, the at least one identification mechanism, and the hand washing detection mechanism to determine whether the person entering the room activates the soap dispenser within a threshold period of time after entering the room and to provide a notification of a failure to activate the soap dispenser that comprises an identity of the person until the person activates the soap dispenser, wherein the monitoring mechanism is operative to verify an identity of an employee and to monitor a time from room entry to activation of the soap dispenser for each of a plurality of persons entering the room.

16. The method of claim 6, wherein determining whether the person activates the soap dispenser within the threshold period of time comprises determining whether an electrical or optical switch corresponding to the soap dispenser has been activated.

17. The method of claim 6, further comprising:

determining whether the person activates the soap dispenser within a post-notification threshold period of time after the notification has been provided; and providing the notification to a facility employee if the person does not activate the soap dispenser within the post-notification threshold period of time.

18. The method of claim 11, wherein determining whether the person activates the soap dispenser within the threshold period of time comprises determining whether an electrical or optical switch corresponding to the soap dispenser has been activated.

19. The method of claim 11, further comprising:

determining whether the person activates the soap dispenser within a post-notification threshold period of time after the notification has been provided; and providing the notification to a facility employee if the person does not activate the soap dispenser within the post-notification threshold period of time.

* * * * *